US010022987B2

(12) United States Patent
Dvori et al.

(10) Patent No.: US 10,022,987 B2
(45) **Date of Patent: *Jul. 17, 2018**

(54) MEDIA SUPPORT

(71) Applicant: HEWLETT-PACKARD INDUSTRIAL PRINTING LTD, Netanya (IL)

(72) Inventors: Yaron Dvori, Givataim (IL); Yuval Dim, Moshav Haniel (IL); Alex Veis, New Industrial Area (IL)

(73) Assignee: HP SCITEX LTD., Netanya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/908,200

(22) PCT Filed: Nov. 12, 2013

(86) PCT No.: PCT/IL2013/050932

§ 371 (c)(1),
(2) Date: Jan. 28, 2016

(87) PCT Pub. No.: WO2015/015482

PCT Pub. Date: Feb. 5, 2015

(65) Prior Publication Data

US 2016/0176204 A1 Jun. 23, 2016

(30) Foreign Application Priority Data

Nov. 12, 2013 (WO) ..... PCT/IL2013/050932

(51) Int. Cl.
*B41J 11/00* (2006.01)
*B41J 11/06* (2006.01)
(Continued)

(52) U.S. Cl.
CPC ..... *B41J 11/0085* (2013.01); *B41J 11/006* (2013.01); *B41J 11/06* (2013.01); *B41J 13/0072* (2013.01); *B41J 13/226* (2013.01)

(58) Field of Classification Search
CPC ..... B41J 11/0085; B41J 11/06; B41J 11/007; B41J 29/38; B41J 13/226; B41J 11/02; B41J 11/006; B41J 13/0072
(Continued)

(56) References Cited

U.S. PATENT DOCUMENTS 3,306,805 A 2/1967 Klein et al.
3,720,433 A 3/1973 Rosfelder
(Continued)

FOREIGN PATENT DOCUMENTS

CN 1517229 8/2004
CN 101676106 3/2010
(Continued)

OTHER PUBLICATIONS

Andersson,, H. et al. ; Evaluation of Coating Applied to Flexible Substrates to Enhance Quality of Ink Jet Printed Silver Nano-Particle Structures~IEEE: 342-348; V 2; #2 ; Feb. 2012.
(Continued)

*Primary Examiner* — Jannelle M Lebron
(74) *Attorney, Agent, or Firm* — Dierker & Kavanaugh, P.C.

(57) ABSTRACT

In one example, a media support includes a platen and multiple suction cups in the platen. Each suction cup in the platen has a port through which air may be evacuated from the cup.

16 Claims, 7 Drawing Sheets

(51) Int. Cl.
*B41J 13/00* (2006.01)
*B41J 13/22* (2006.01)

(58) Field of Classification Search
USPC ..... 347/16, 101, 104
See application file for complete search history.

(56) References Cited

U.S. PATENT DOCUMENTS

| | | | | |
|---|---|---|---|---|
| 4,221,356 | A | 9/1980 | Fortune | |
| 5,671,910 | A * | 9/1997 | Davies | B25B 11/005 269/21 |
| 6,182,956 | B1 | 2/2001 | McMillan | |
| 6,346,154 | B1 | 2/2002 | Briend et al. | |
| 6,357,869 | B1 | 3/2002 | Rasmussen et al. | |
| 6,425,565 | B1 | 7/2002 | Montague | |
| 6,543,948 | B2 | 4/2003 | Beehler et al. | |
| 6,571,709 | B1 | 6/2003 | Marincic et al. | |
| 7,597,319 | B2 | 6/2009 | Dangelewicz et al. | |
| 7,922,174 | B2 | 4/2011 | Panides et al. | |
| 8,038,151 | B2 | 10/2011 | Fukui | |
| 8,534,826 | B2 | 9/2013 | Kobayashi et al. | |
| 2009/0295898 | A1 * | 12/2009 | Takatsuka | B41J 11/0015 347/104 |
| 2010/0235249 | A1 | 9/2010 | Panides et al. | |
| 2011/0025796 | A1 | 2/2011 | Matsuya | |
| 2011/0043563 | A1 | 2/2011 | Houjou | |
| 2011/0102531 | A1 * | 5/2011 | Ozaki | B41J 11/0085 347/104 |
| 2011/0115867 | A1 | 5/2011 | Forgacs et al. | |
| 2011/0292145 | A1 | 12/2011 | Hoover et al. | |
| 2011/0317144 | A1 | 12/2011 | Baxter et al. | |
| 2013/0162742 | A1 | 6/2013 | Inoue et al. | |
| 2014/0049590 | A1 | 2/2014 | Tateishi et al. | |
| 2014/0160213 | A1 | 6/2014 | Atwood et al. | |

FOREIGN PATENT DOCUMENTS

| | | |
|---|---|---|
| CN | 201501166 | 6/2010 |
| CN | 101870204 | 10/2010 |
| CN | 102019769 | 4/2011 |
| CN | 102019769 A | 4/2011 |
| CN | 102431293 | 5/2012 |
| CN | 102431293 A | 5/2012 |
| JP | 9166928 | 6/1997 |
| JP | H10520 | 1/1998 |
| JP | 2009107768 | 5/2009 |
| JP | 2012056097 | 3/2012 |
| WO | WO-9014952 | 12/1990 |
| WO | WO-2010008390 | 1/2010 |
| WO | WO-2012147760 | 11/2012 |

OTHER PUBLICATIONS

Odgs S & S, Vancouver ; How to Hold Media Flat on the Printer Table ; https://dgs.oce.com/PrinterSupport/Arizona ; Jun. 11, 2007 ~3 pages.

PCT Search Report/Written Opinion~Application No. PCT/IL2013/050932 dated Apr. 24, 2014~16 pages.

Yi-ming, W. et al. ; Research on Inverse Seeking Designing Method for Suction Nozzle of Paper Separation Mechanism ; http://en.cnki.com.cn: 2005~3 pages.

* cited by examiner

MEDIA SUPPORT

BACKGROUND

Large format inkjet printers use vacuum tables to hold down foamboard, cardboard and other inflexible or semi-flexible print media for printing. High capacity vacuum pumps are used to develop the hold down forces needed to keep large sheets of such media flat during printing.

DRAWINGS

The same part numbers designate the same or similar parts throughout the figures. The figures are not necessarily to scale. The sin of some parts may be exaggerated to better illustrate the example shown.

DESCRIPTION

Corrugated cardboard is widely used to make boxes. Although inkjet printers can print high quality images on corrugated cardboard, it is difficult to hold down corrugated cardboard flat in the print zone for high quality inkjet printing. Consequently, special, more expensive corrugated boards are often used for inkjet printing. A new print media support has been developed to hold down regular, less expensive corrugated cardboard flat for inkjet printing. The new media support uses a suction cup platen to increase the hold down force applied to corrugated cardboard and other print media. In one example of the new media support, the media support platen includes an arrangement of suction cups through which vacuum may be applied to media on the platen. Testing indicates that, for the same vacuum line pressure, the hold down force applied by the suction cups is much greater than the hold down force applied by a vacuum hole alone. Thus, significantly greater hold down forces may be applied, and through fewer vacuum holes if desired. In one specific implementation, a set of detachable plates is included to cover some or all of the suction cup platen for printing on flexible print media where the larger vacuum of the suction cup platen is not desired.

These and other examples are shown in the figures and described below with reference to supporting print media in an inkjet printer. Examples of the new media support, however, are not limited to inkjet printing or to supporting print media, but may be implemented to support other types of media and for applications other than inkjet printing.

Accordingly, the examples shown and described illustrate but do not limit the invention, which is defined in the Claims following this Description.

Figure 1:
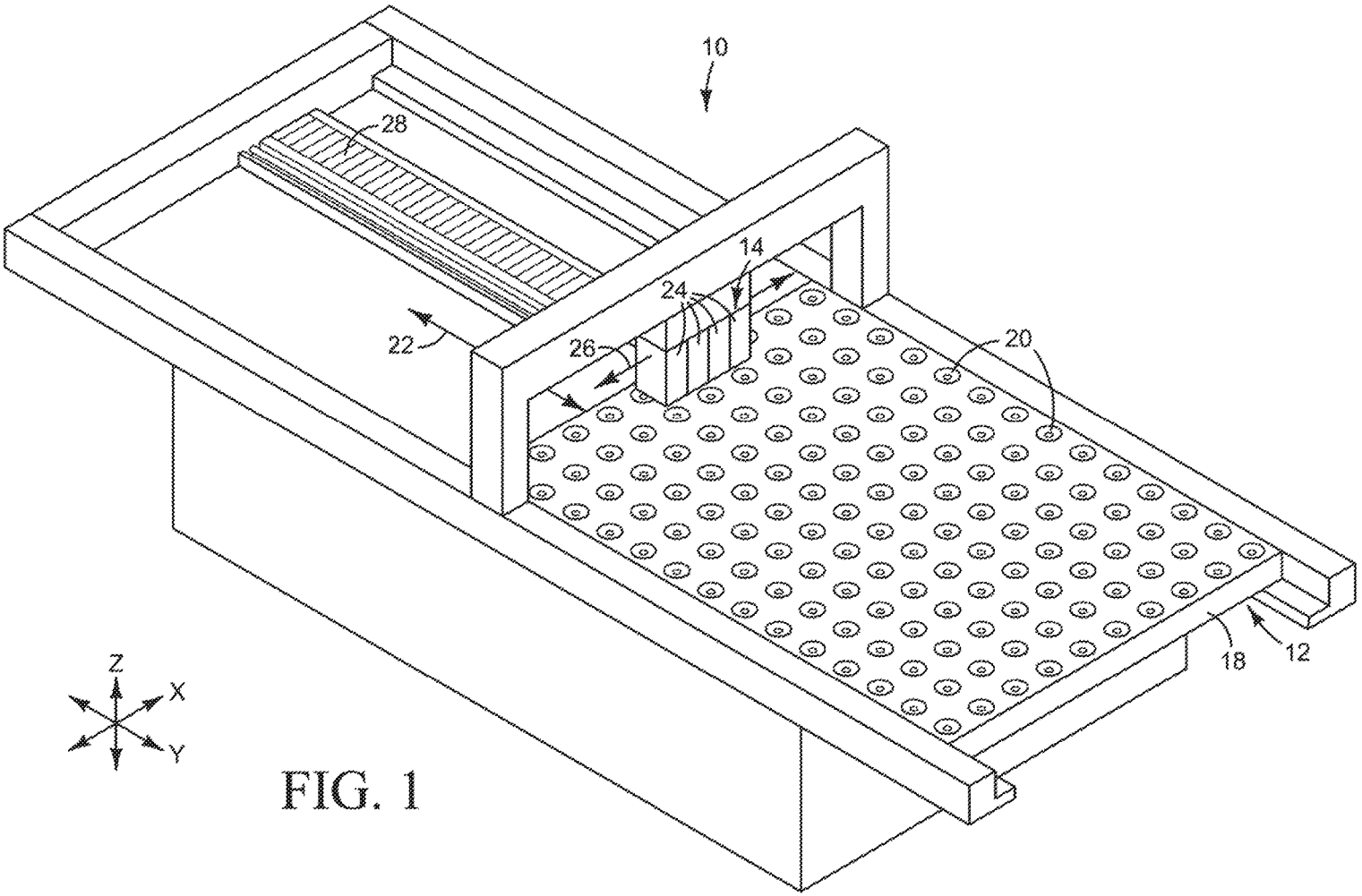
FIGS. 1 and 2 illustrate a printer implementing one example of a suction cup platen to support print media during printing.
Figure 2:
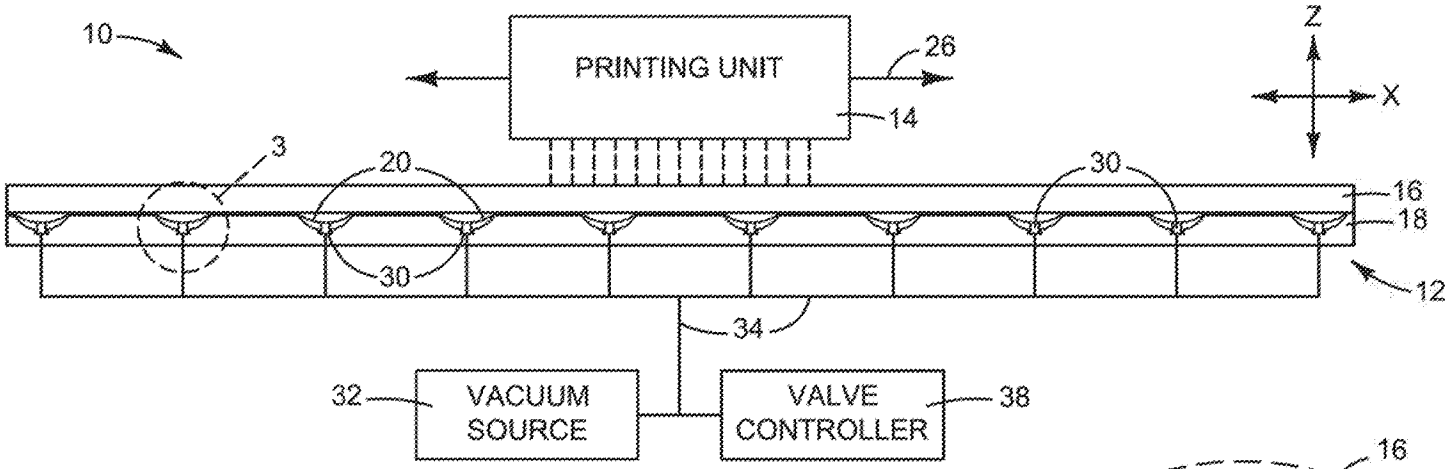
Figure 3:
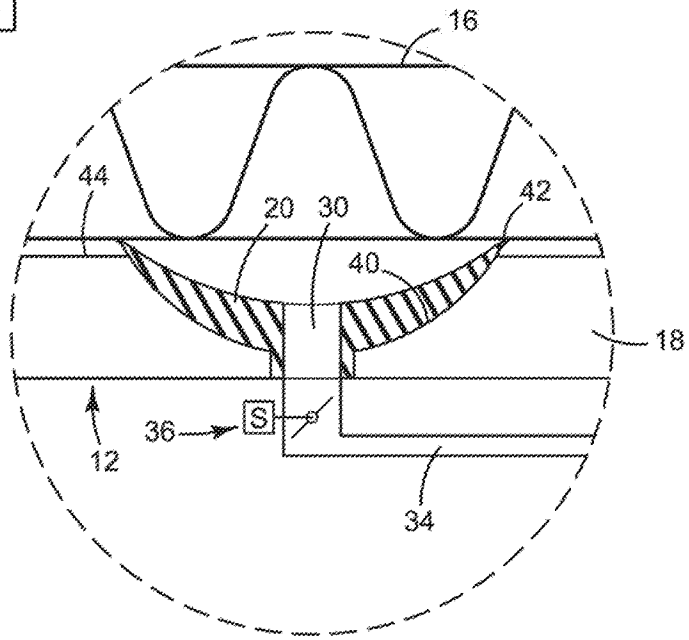
FIG. 3 is a detail from FIG. 2 showing one of the suction cups in the platen.

FIG. 1 illustrates an inkjet printer 10 implementing one example of a new media support 12. FIG. 2 is an elevation view illustrating a media support 12 in printer 10. FIG. 3 is a blow-up from FIG. 2 showing part of media support 12 in more detail. Referring to FIGS. 1-3, printer 10 includes a printing unit 14 positioned over media support 12 supporting a sheet of corrugated cardboard or other print media 16. Print media 16 is omitted from FIG. 1 to better illustrate media support 12. Media support 12 includes a platen 18 and suction cups 20 in platen 16. In the example shown in FIGS. 1 and 2, suction cups 20 are arranged uniformly in rows and columns that cover the full extent of platen 18. Also, in the example shown, platen 18 is configured as a movable, flat plate to support large size print media 16. Suction cup platen 18 is moved in the Y direction back and forth under printing unit 14 on a track or other suitable drive system 28, as indicated by arrows 22 in FIG. 1. In the example shown, printing unit 14 is configured as a group of inkjet pens 24 scanned back and forth over media 16 in the X direction, as indicated by arrows 26 in FIG. 1. Other configurations are possible. For example, platen 18 could be configured as a rotating drum (with suction cups 20), and/or printing unit 14 could be configured as a media wide array of ink pens.

A port 30 at the back of each suction cup 20 is operatively connected to a pump or other vacuum source 32 through a network of vacuum lines 34 and valves 36 connected to a valve controller 38. In operation, air is evacuated from each cup 20 through port 30 under negative pressure from pump 32 to apply suction to print media 16. Vacuum control valves 36 may be connected to individual suction cups 20 or to groups of suction cups 20 as necessary or desirable for vacuum control. For example, if print media 16 does not cover all of the suction cups 20 in platen 18, then it may be desirable to disconnect the vacuum to the uncovered suction cups to minimize vacuum leakage and thus reduce the capacity needed for pump 32. For another example, it may be desirable for holding some print media 16 to have fewer than all of the suction cups 20 covered by the print media actually drawing a vacuum on the media. In the example shown, as best seen in FIG. 3, each suction cup 20 is configured as a discrete part embedded in a recess 40 in platen 18. Also, in the example shown, a flexible rim 42 of each suction cup 20 protrudes slightly above the front surface 44 of platen 18 to help seal each cup 20 tightly against print media 16 when suction is applied to cups 20, increasing the hold down force applied to print media 16.

Figure 4:
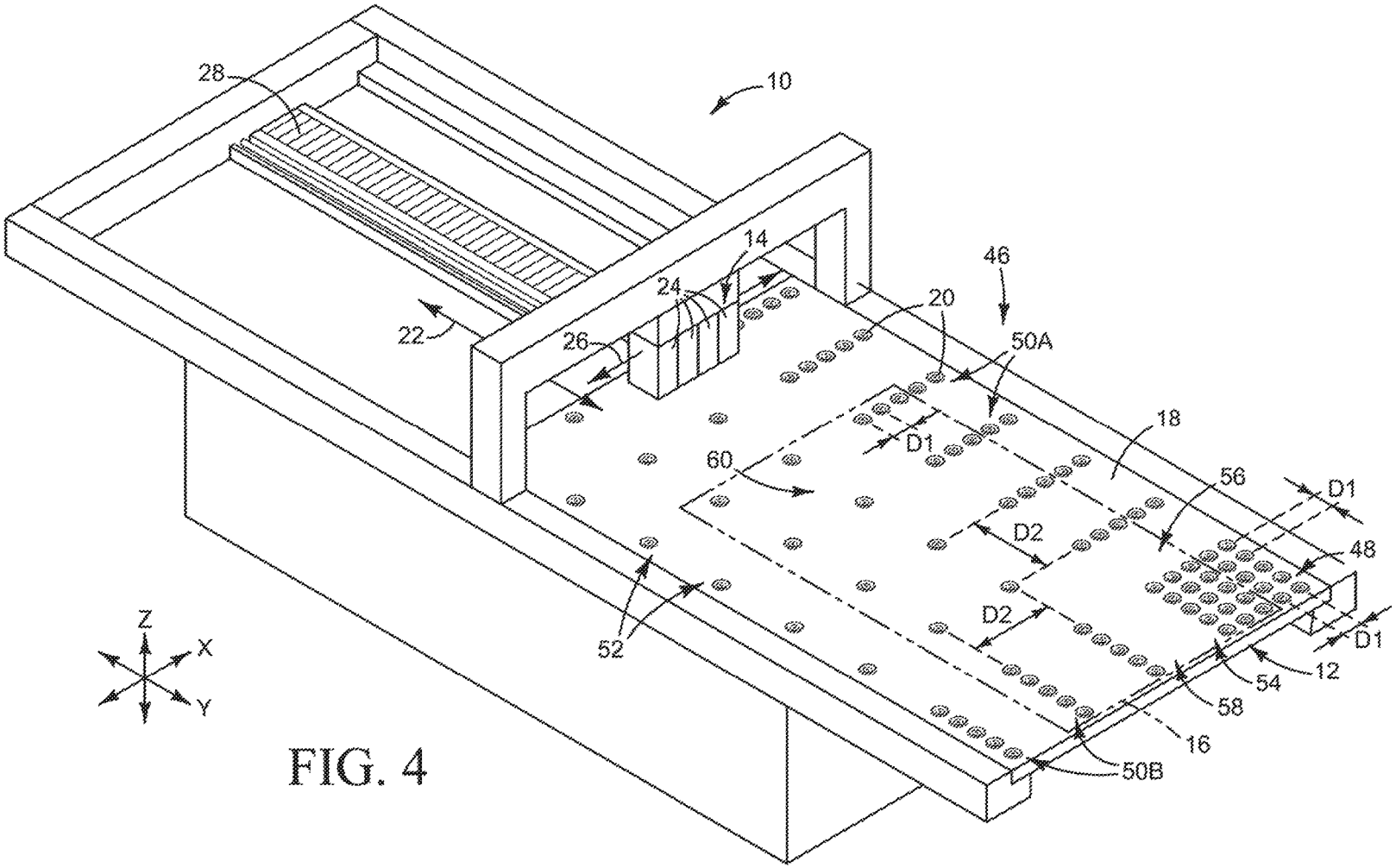
FIGS. 4 and 5 illustrate a printer implementing another example of a suction cup platen in which the density of the suction cups varies in different parts of the platen.
Figure 5:
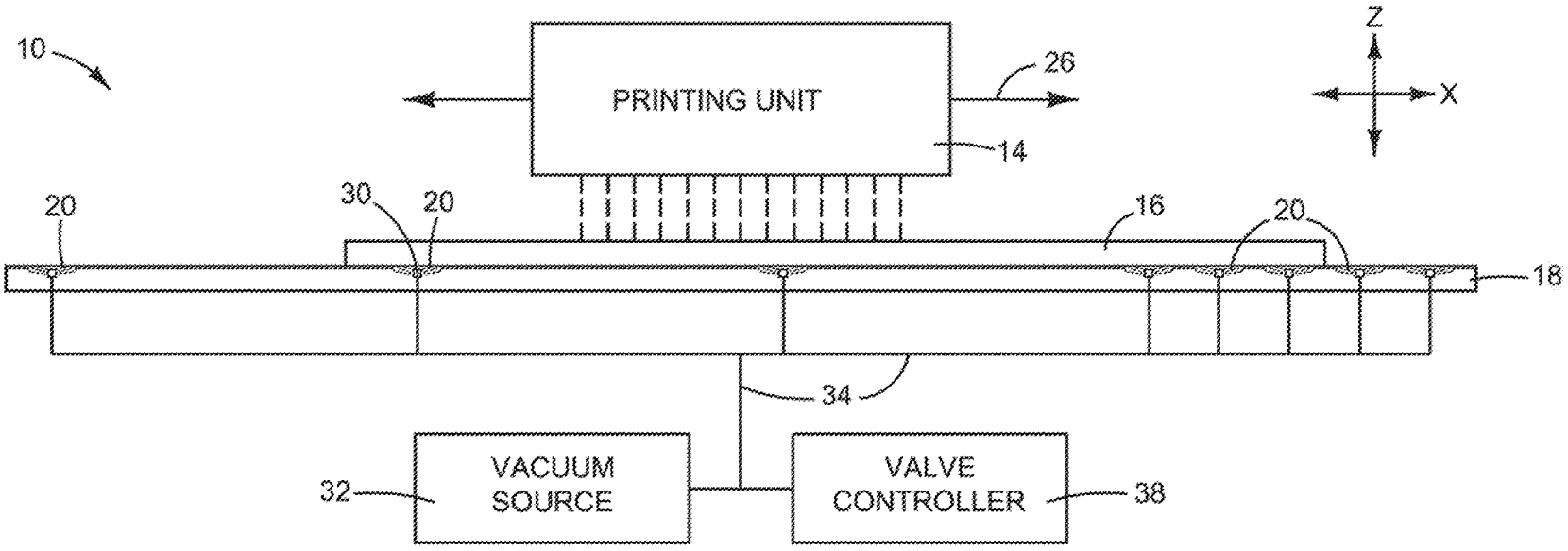
Figure 6:
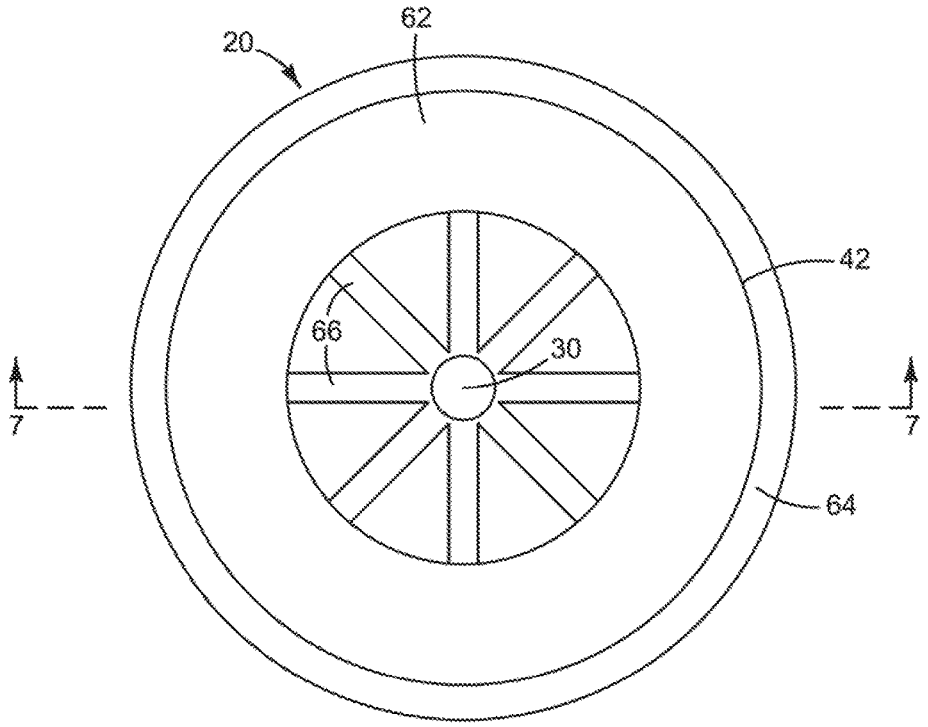
FIGS. 6 and 7 are plan and section views, respectively, showing a suction cup from the platen of FIGS. 4 and 5 in more detail.
Figure 7:
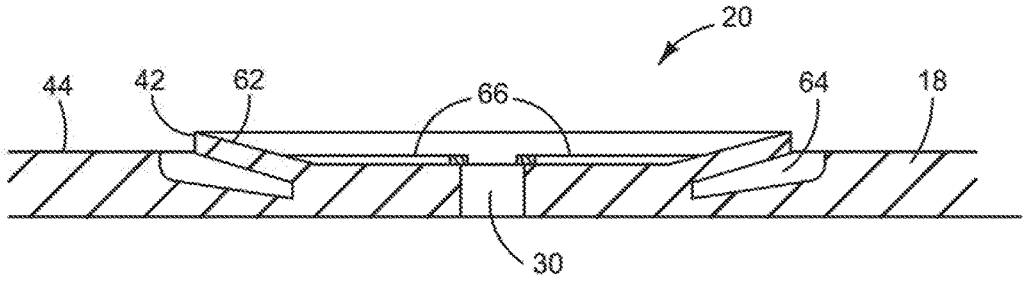

FIGS. 4 and 5 illustrate a printer 10 implementing another example of a suction cup platen 18 in which the density of suction cups 20 varies in different parts of the platen 18. FIGS. 6 and 7 are plan and section views, respectively, showing a suction cup 20 from platen 18 in FIGS. 4 and 5 in more detail.

Referring first to FIGS. 4 and 5, the arrangement 46 of suction cups 20 in platen 18 includes a first, more dense part 48, second, less dense parts 50A, 50B, and a third, even less dense part 52. The arrangement 46 of suction cups 20 with more and less dense parts 48-52 is configured to minimize the number of suction cups needed to deliver the desired hold down forces to print media 16.

In the example shown, suction cups 20 in the densest part 48 are spaced apart (on center) a first distance D1 in both the X and Y directions. Suction cups 20 in the middle density parts 50A, 50B are spaced apart first distance D1 in one direction (the X direction in part 50A and the Y direction in part 50B) and a second, longer distance D2 in the other direction. Suction cups 20 in sparse part 52 are spaced apart the second distance D2 in both the X and Y directions. In one example, each less dense part 50A, 50B and 52 includes a uniform arrangement of suction cups 20 in which the spacing between cups in the X direction or Y direction, or both, is an integer multiple of more dense part 48 (e.g., D2÷D1=2, 3, 4 etc.) to help ensure the edges of print media 16 can be placed close to a line of suction cups.

A variable density arrangement of vacuum holes that may be adapted to a suction cup platen 18 such as that shown in FIGS. 4 and 5 is disclosed in international patent application PCT/IL2012/050220 filed Jun. 25, 2012 and titled Vacuum Hole Array, which is incorporated herein by reference in its entirety.

Print media 16 is positioned on platen 18 with one corner 54 over dense part 50 and adjacent sides 56, 58 aligned over middle density parts 50A, 50B so that the opposite sides 60, 62 are aligned over middle and sparse density parts 50A, 50B and 52 as shown in FIG. 4. This positioning allows the application of greater suction along the perimeter of print media 16 where the risk of media un-flatness (curling, for example) is greater and lesser suction over an interior 64 of media 16 where the risk of un-flatness is lesser. Other suitable configurations are possible. For example, more or fewer density variations may be used across platen 18 and the spacing of the suction cups in each density part as well as the spacing between parts may be varied as necessary or desirable to accommodate different sizes and types of print media 16.

Referring now also to FIGS. 6 and 7, each suction cup 20 is molded into or otherwise formed as an integral part of platen 18. Referring specifically to the detail views of FIGS. 6 and 7, each suction cup 20 includes a flexible ring 62 suspended in a recess 64 with rim 42 protruding slightly above front surface 44 of platen 18 so that cup 20 can flex as suction is applied to print media 16. Rim 42 is formed at the perimeter of ring 62 which surrounds port 30 in space such that ring 62 may flex into recess 64 away from front surface 44 when print media 16 is sucked onto rim 42. Flexible rings 62 help suction cups 20 conform to any waves, undulations and other irregularities typical of corrugated cardboard print media 16 so that each cup 20 maintains a better seal to increase the hold down force. Each cup 20 also includes a series of flat ridges 66 that project radially from vacuum port 30. Suction pulls print media 16 down onto surface of ridges 66 as ring 62 flexes into recess 64.

Figure 8:
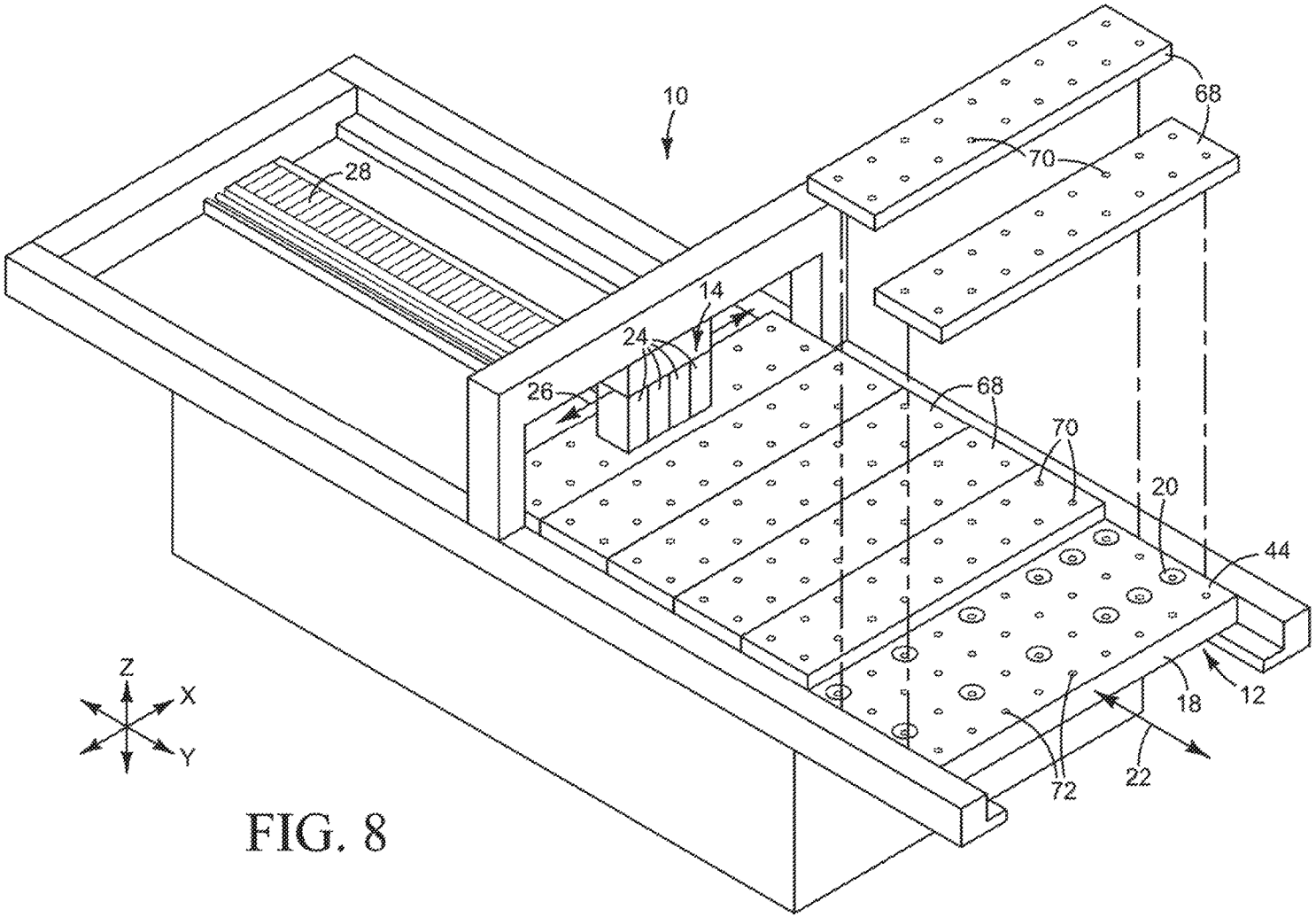
FIG. 8 illustrates a printer implementing another example of a suction cup platen that includes detachable cover plates to support flexible print media during printing.

FIG. 8 illustrates a printer 10 implementing another example of a suction cup platen 18 that includes one or more detachable cover plates 68 configured to support a flexible print media. Referring to FIG. 8, each cover plate 68 includes vacuum holes 70 and, in this example, platen 18 also includes vacuum holes 72 interspersed with suction cups 20. Each vacuum hole 70 in plates 68 is aligned with a suction cup 20 or a vacuum hole 72 in platen 18. A suction cup platen may not be desirable for holding vinyl, paper and other more flexible print media. Accordingly, detachable vacuum plates 68 may be installed over platen 18 for printing on flexible print media. Vacuum holes 72 in platen 18 may be deactivated for printing on cardboard and other less flexible print media. Any suitable technique may be used to attach plates 68 to platen 18 including, for example, vacuum (e.g. using suction cups 20), mechanical fasteners or magnetic fasteners for metal plates. In the example shown, multiple smaller plates 68 are used for ease of installation and to accommodate different sizes of flexible media sheets. The number and size of detachable plates 68 may be varied as desired depending on the print media and the particular printing environment.

Figure 9:
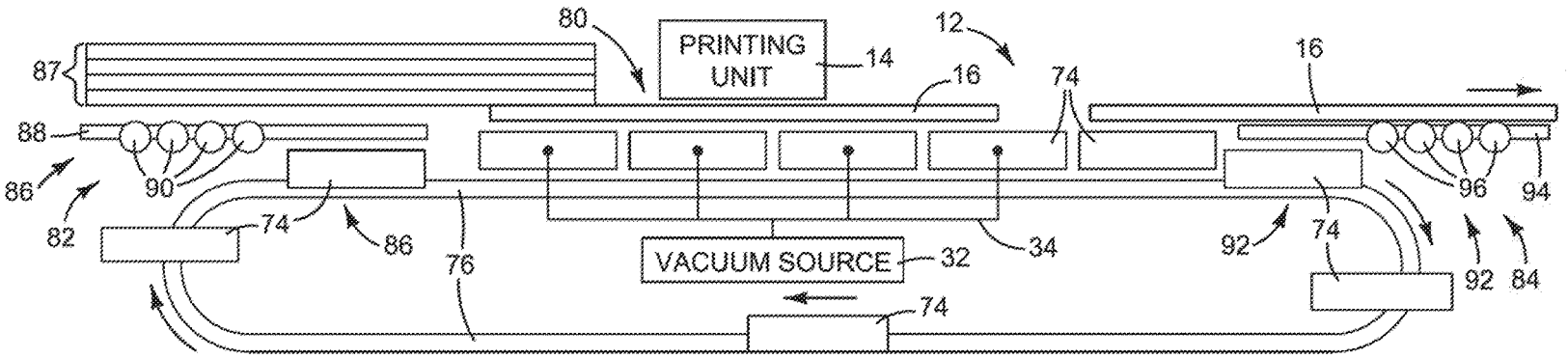
FIG. 9 illustrates a printer implementing another example of a suction cup platen that uses movable pallets to support print media during printing.
Figure 10:
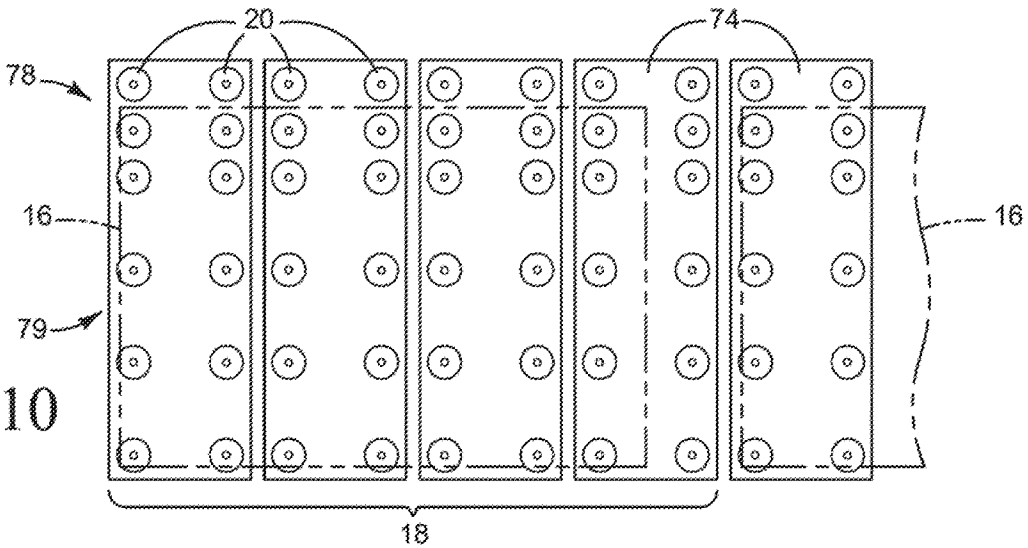
FIG. 10 is a plan view illustrating some of the pallets in the printer shown in FIG. 9.

FIG. 9 illustrates a printer 10 implementing another example of a suction cup platen 18 that uses movable pallets 74 to support print media 16 during printing. FIG. 10 is a plan view illustrating some of the pallets 74 in printer 10 shown in FIG. 9. Referring to FIGS. 9 and 10, media support 12 includes pallets 74 arranged to circulate endlessly past printing unit 14 on a track 76, In this example, the suction cups 20 on each pallet 74 are arranged in a more dense part 78 and a less dense part 79. The pallets 74 are grouped together to form platen 18 to support media 16 in a printing zone 80. Print media 16 is loaded on to pallets 74 at a loading zone 82 and unloaded from pallets 74 at an unloading zone 84. Printer 10 includes a loading mechanism 86 configured to hold a stack 87 of print media 16 and to load individual print media 16 on to pallets 74, for example using a platform 88 and rollers 90. Printer 10 also includes an unloading mechanism 92 configured to unload individual print media 16 from pallets 74, for example using a platform 94 and rollers 96.

In the example shown, pallets 74 are temporarily grouped together in printing zone 80 to form a suction cup platen 18. Each pallet 74 in printing zone 80 is connected to vacuum source 32 to apply a vacuum to suction cups 20 to hold print media 16 flat for printing. It is expected that each pallet 74 will usually be significantly smaller than each print media sheet 16. The size, number and spacing of pallets 74 to temporarily form platen 18 may be varied from that shown to accommodate different sizes and types of print media 16. A pallet system that may be adapted for use in a printer 10 such as that shown in FIG. 9 is disclosed in international patent application PCT/US2011/024372 filed Feb. 10, 2011 and titled Media Transport Assembly, which is incorporated herein by reference in its entirety.

As noted at the beginning of this description, the examples shown in the figures and described above illustrate but do not limit the invention. Other forms, details, and examples may be made and implemented. Therefore, the foregoing description should not be construed to limit the scope of the invention, which is defined in the following claims.

The invention claimed is:

1. A media support, comprising:

a platen and multiple suction cups in the platen, each suction cup having a port through which air may be evacuated from the suction cup and a flexible rim surrounding the port along an outer perimeter of the suction cup; and a detachable plate configured to cover at least part of the platen, the plate having holes therein through which vacuum may be applied to media on the plate and each hole in the plate aligned with a suction cup or a vacuum hole in the platen when the plate is attached to the platen.

2. The media support of claim 1, wherein the density of suction cups in the platen varies between different parts of the platen.

3. The media support of claim 1, wherein each suction cup comprises a discrete part embedded in the platen.

4. The media support of claim 1, wherein each suction cup comprises an integral part of the platen.

5. The media support of claim 1, wherein the rim of each suction cup protrudes from a face of the platen.

6. The media support of claim 5, wherein the rim is formed at the perimeter of a flexible ring surrounding the port in a space such that the ring may flex into the space away from the face of the platen when a media supported on the face of the platen is sucked onto the rim.

7. The media support of claim 6, wherein each suction cup includes multiple ridges each extending radially out from the port toward the rim.

8. A media support, comprising:

a flat, rigid platen having multiple suction cups therein to apply a vacuum to media on the platen, each suction cup having a port through which air may be evacuated from the suction cup; and a detachable plate configured to cover at least part of the platen, the plate having holes therein through which vacuum may be applied to media on the plate and each hole in the plate aligned with a suction cup or a vacuum hole in the platen when the plate is attached to the platen.

9. The media support of claim 8, wherein the plate comprises multiple detachable plates each configured to cover part of the platen and each having holes therein through which vacuum may be applied to media on the plate, each hole in each plate aligned with a suction cup or a vacuum hole in the platen when the plate is attached to the platen.

10. The media support of claim 9, further comprising multiple vacuum holes in the platen interspersed among the suction cups and wherein some of the holes in each plate are aligned with a suction cup in the platen and some of the holes in each plate are aligned with a vacuum hole in the platen.

11. The media support of claim 8, wherein the density of suction cups in the platen varies between different parts of the platen.

12. The media support of claim 8, wherein each suction cup comprises a discrete part embedded in the platen.

13. The media support of claim 8, wherein each suction cup comprises an integral part of the platen.

14. The media support of claim 8, wherein each suction cup includes a rim surrounding the port, the rim protruding from a face of the platen.

15. The media support of claim 14, wherein the rim is formed at the perimeter of a flexible ring surrounding the port in a space such that the ring may flex into the space away from the face of the platen when a media supported on the face of the platen is sucked onto the rim.

16. The media support of claim 15, wherein each suction cup includes multiple ridges each extending radially out from the port toward the rim.

* * * * *